US006627371B2

(12) United States Patent
Hasegawa et al.

(10) Patent No.: US 6,627,371 B2
(45) Date of Patent: Sep. 30, 2003

(54) APPARATUS AND METHOD FOR FORMING IMAGE

(75) Inventors: Mitsuhiro Hasegawa, YamatoKoriyama (JP); Nobuhiko Nakano, Nara (JP); Shigeyuki Wakada, Nara (JP); Rikiya Matsuo, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/061,308

(22) Filed: Feb. 4, 2002

(65) Prior Publication Data

US 2002/0115013 A1 Aug. 22, 2002

(30) Foreign Application Priority Data

Feb. 19, 2001 (JP) ..... 2001-041372

(51) Int. Cl.[7] ..... G03G 13/16
(52) U.S. Cl. ..... 430/126; 430/69; 399/297
(58) Field of Search ..... 430/60, 65, 69, 430/126; 399/297

(56) References Cited

U.S. PATENT DOCUMENTS 6,048,657 A * 4/2000 Herbert et al. ..... 430/127
6,156,468 A * 12/2000 Wehelie et al. ..... 430/65
6,331,371 B1 * 12/2001 Matsui ..... 430/65
6,416,389 B1 * 7/2002 Perry et al. ..... 451/36

FOREIGN PATENT DOCUMENTS

JP 5-26191 4/1993

* cited by examiner

*Primary Examiner*—John Goodrow
(74) *Attorney, Agent, or Firm*—Nixon & Vanderhye P.C.

(57) ABSTRACT

An image forming apparatus and a process for forming an image is provided whereby problems in an image such as interference fringes can be eliminated even at a higher resolution to improve image quality.

An image forming apparatus of this invention has a configuration wherein an electrostatic latent image is formed by exposing an electrophotographic photoreceptor having a photosensitive layer 18 formed via a undercoating layer 16 on a conductive support 110 with the maximum surface roughness defined by the equation:

$$(0.0006x+0.34)\ \mu m \leqq Rmax \leqq 2.5\ \mu m$$

wherein x=a resolution; visualizing the latent image with a toner to give a visualized image; and transferring the visualized image to a transfer medium.

4 Claims, 6 Drawing Sheets

Fig. 3

| | | RESOLUTION/dpi | | | |
|---|---|---|---|---|---|
| | | 600 | 1200 | 1800 | 2400 |
| ROUGHNESS OF A BASE PIPE Rmax/ μ m | 0.58 | × | × | × | × |
| | 0.68 | ○ | × | × | × |
| | 0.884 | ○ | × | × | × |
| | 0.952 | ○ | × | × | × |
| | 1.02 | ○ | ○ | × | × |
| | 1.088 | ○ | ○ | × | × |
| | 1.156 | ○ | ○ | × | × |
| | 1.224 | ○ | ○ | × | × |
| | 1.292 | ○ | ○ | × | × |
| | 1.36 | ○ | ○ | ○ | × |
| | 1.564 | ○ | ○ | ○ | × |
| | 1.7 | ○ | ○ | ○ | ○ |
| | 2.04 | ○ | ○ | ○ | ○ |
| | 2.38 | ○ | ○ | ○ | ○ |
| | 2.516 | × | × | × | × |
| | 2.584 | × | × | × | × |

Fig. 4

| | | | | |
|---|---|---|---|---|
| 0.58 | × | × | × | × |
| 0.68 | ○ | × | × | × |
| 0.884 | ○ | × | × | × |
| 0.952 | ○ | × | × | × |
| 1.02 | ○ | ○ | × | × |
| 1.088 | ○ | ○ | × | × |
| 1.156 | ○ | ○ | × | × |
| 1.224 | ○ | ○ | × | × |
| 1.292 | ○ | ○ | × | × |
| 1.36 | ○ | ○ | ○ | × |
| 1.564 | ○ | ○ | ○ | × |
| 1.7 | × | × | × | × |
| 2.04 | × | × | × | × |
| 2.38 | × | × | × | × |
| 2.516 | × | × | × | × |
| 2.584 | × | × | × | × |

Fig. 5

| | | RESOLUTION/dpi | | | |
|---|---|---|---|---|---|
| | | 600 | 1200 | 1800 | 2400 |
| ROUGHNESS OF A BASE PIPE Rmax/ $\mu$ m | 0.58 | × | × | × | × |
| | 0.68 | ○ | × | × | × |
| | 0.884 | ○ | × | × | × |
| | 0.952 | ○ | × | × | × |
| | 1.02 | ○ | ○ | × | × |
| | 1.088 | ○ | ○ | × | × |
| | 1.156 | × | × | × | × |
| | 1.224 | × | × | × | × |
| | 1.292 | × | × | × | × |
| | 1.36 | × | × | × | × |
| | 1.564 | × | × | × | × |
| | 1.7 | × | × | × | × |
| | 2.04 | × | × | × | × |
| | 2.38 | × | × | × | × |
| | 2.516 | × | × | × | × |
| | 2.584 | × | × | × | × |

APPARATUS AND METHOD FOR FORMING IMAGE

BACKGROUND OF THE INVENTION

1. Field of the Invention

The present invention relates to an apparatus and method for electrophotographic image forming.

2. Description of the Prior Art

A process for electrophotographic image forming will be described with reference to FIG. 7.

A process for forming an image comprises the steps of charging, exposure, development, transferring, cleaning, fixation and charge removal. A photoreceptor drum 1 is provided in such a way that it can rotate to a direction indicated by an arrow S1. The surface of the photoreceptor drum 1 is evenly charged to a predetermined quantity of charge with charging means 2 such as a corona charger and a contact-type charging roller, and may carry an electrostatic latent image created by a predetermined electrostatic latent image potential generated by exposure means 3.

The photoreceptor drum 1 comprises a conductive substrate made of a metal or resin, an undercoating layer formed on the surface of the substrate, and a photosensitive layer formed on the undercoating layer. The photosensitive layer consists of a relatively thinner charge generation layer (CGL) formed on the undercoating layer and a relatively thicker charge transport layer (CTL) mainly formed of polycarbonate which is formed as the outer layer. In the charge generation layer, exposure generates carriers whereby a charge on the photoreceptor drum 1 is cancelled to generate the above electrostatic latent image potential.

The electrostatic latent image carried on the photoreceptor drum 1 is transported to a developing area 42 in contact with a developer carrier 41 as the drum 1 rotates. The developer carrier 41 which rotates to a direction indicated by an arrow S3 opposite to the rotation direction S1 of the photoreceptor drum 1 is pressed on the photoreceptor drum 1. Thus, a toner 10 carried in the developer carrier 41 is moved and adheres to the photoreceptor drum 1 according to the electrostatic latent image on the drum to visualize the electrostatic latent image, and thus, development is completed. A predetermined bias voltage is applied to the developer carrier 41 from an unshown power supply connected thereto.

After development, the toner 10 adhering to the photoreceptor drum 1 is transferred to a predetermined transfer region, to which a transfer material P such as a paper is supplied by a paper feeder and the transfer material is synchronously brought into contact with the toner image on the photoreceptor drum 1. The transfer means 5 provided in the transfer region may be a charger type or a contact roller type with a high voltage power supply and applies to the photoreceptor drum 1 a voltage having a polarity of a side to which the toner 10 is to be transferred. Thus, the toner 10 is moved to the transfer material P so that the toner image is transferred. After separating the transfer material P from the photoreceptor drum 1, the toner on the transfer material P is fixed by a fixing means 8. For example, the material is fixed by thermal melting and then ejected from the apparatus. The surface of the photoreceptor drum 1 after transfer is cleaned by a cleaning means 6 and the residual charge on the surface is removed by a charge erasing means 7 to electrically initialize the surface. The charge erasing means 7 includes a charge erase lamp and a contact charge eraser.

Conventionally a gas laser has been used in a copier or printer employing an electrophotographic process where line scanning is conduced with a laser beam, but a semiconductor laser has been recently used because of its reduced size and cost.

Such a semiconductor laser generally requires an electrophotographic photoreceptor with high sensitivity in a long wavelength range of 750 nm or more, and attempts have been made for developing such an electrophotographic photoreceptor.

It, however, has a drawback that laser beam exposure to a photoreceptor which is sensitive to a long wavelength light may cause interference fringes in the toner image formed, leading to poor image reproduction.

It may be partly because, as shown in FIG. 8, in a conventional laminated photoreceptor having a photosensitive layer consisting of a conductive support 11, a charge generation layer 12 and a charge transport layer 15, a laser beam enters as an incident beam into the photosensitive layer, and is then reflected at the interface between the photosensitive layer and the support and the interface between the photosensitive layer and the air as a reflected beam 21, and interface fringes are formed due to a phase difference between the reflected beam 21 and the incident beam 19.

To overcome the drawback, there have been proposed elimination of multiple reflection in a photosensitive layer by, for example, roughening the surface of a base pipe (conductive support) in a photoreceptor by anodization or sand blasting, or using a light absorbing layer or antireflection layer between a photosensitive layer and a base pipe. In practice, however, interference fringes appearing during image forming cannot be completely eliminated.

For example, Japanese Patent Publication No. 5-26191 has disclosed a technique in which irregularity on the order of 0.1 to 1.0 $\mu$m is formed on a base surface.

With the recent improvement of image quality and resolution, it has been found that a resolution of 1200 dpi or more may lead to interference fringes even in such a rough surface. It might be because as the dot number in a unit area increases, reflected light is increased, so interference due to the reflected light is increased and the increased interference appears as interference fringes so that a conventional surface roughness cannot eliminate the increased interference fringes. It is, therefore, necessary to further roughen the surface of a base pipe for improving light scattering so as to deal with interference fringes associated with improvement in image quality and resolution. On the other hand, when a roughness (the maximum roughness Rmax) is excessively high in the support pipe surface, a large rough area may act as a carrier injection area to a photosensitive layer to cause a white spot (or black spot when using a reverse developing system) during image formation or appearance of the surface shape of the base pipe in an image formed. Furthermore, an excessively rough surface may cause an uneven film thickness during an application process, leading to problems in an image.

Therefore, an object of the present invention is to provide an image forming apparatus and a method for forming an image whereby problems in an image due to interference fringes can be eliminated at a higher resolution of 1200 dpi or more to improve image quality. Another object of this invention is to economically provide such an apparatus by selecting a base pipe surface roughness Rmax whereby production may be easily managed.

SUMMARY OF THE INVENTION

An image forming apparatus of this invention has a configuration wherein an electrostatic latent image is formed by exposing an electrophotographic photoreceptor having a photosensitive layer formed thereon via an undercoating layer on a conductive support with the maximum surface roughness defined by the equation:

$$(0.0006x+0.34)\ \mu m \leqq Rmax \leqq 2.5\ \mu m$$

where x=a resolution; visualizing the latent image with a toner to give a visualized image; and transferring the visualized image to a transfer medium.

This image forming apparatus comprises a conductive support with a surface roughness within the upper and lower limits so that it can prevent problems in an image (mainly interference fringes) in image forming for improved image quality by exposure with a resolution of 1200 dpi or more using a semiconductor laser beam.

Forming an undercoating layer (a UCL layer) between the photosensitive layer and the conductive support permits uniformly forming subsequent layers, that is, a photosensitive layer, a charge generation layer (CGL) and a charge transport layer (CTL). An area without interference fringes can be made larger than that in an apparatus without an undercoating layer. The undercoating layer may prevent deterioration in charging property during repeated use, reduce a W-charge and improve charging property under the conditions of a low temperature and a low humidity. Furthermore, in manufacturing an image forming apparatus, defining the limits of a surface roughness for a conductive support (base pipe) can allow an apparatus to be produced whereby problems in an image can be minimized, with a lower cost and easier production management.

In the image forming apparatus of this invention, the surface of the conductive support which is in contact with the undercoating layer has a different roughness depending on a resolution, whereby a high quality image with a higher resolution may be achieved.

This invention also provides an image forming apparatus wherein the undercoating layer in the photosensitive layer contains an inorganic oxide.

Thus, in the undercoating layer in which the inorganic oxide is dispersed, its resistance can be controlled and the layer may contribute to reduction of interference fringes by scattering a transmitted light. Even when the surface of the base pipe is rough enough to prevent interference fringes, the roughness may not affect the formed image.

This invention also provides a process for forming an image comprising the steps of forming an electrostatic latent image by exposing an electrophotographic photoreceptor where a photosensitive layer is evenly formed via an undercoating layer on a conductive support having a rough surface with the maximum surface roughness defined by the equation:

$$1.02\ \mu m \leqq Rmax \leqq 2.5\ \mu m,$$

with a laser beam carrying an even charge and image information at a resolution of 1200 dpi or more; visualizing the latent image with a toner into a visualized image; and transferring the visualized image to a transfer medium to form an image.

According to this process, the surface roughness of the conductive support may scatter the reflected light to prevent interference fringes due to exposure with a semiconductor laser at a high resolution.

The undercoating layer (UCL) formed in the photosensitive layer in the photoreceptor drum with a rough surface allows the photosensitive layer to be evenly applied during a dip coating process, resulting in prevention of an uneven image. The undercoating layer can reduce a large rough area in the support and allows a higher upper limit to be selected for a roughness in the conductive support. Furthermore, it can inhibit causes for white spots (or black spots) in an image forming area.

BRIEF DESCRIPTION OF THE DRAWINGS

FIG. 3 is a table showing image results in terms of the surface roughness of a support and a resolution for an electrophotographic photoreceptor in an image forming apparatus according to the present invention;

FIG. 4 is a table showing image results in terms of the surface roughness of a support and a resolution for an electrophotographic photoreceptor in an image forming apparatus in which an undercoating layer does not comprise an inorganic oxide;

FIG. 5 a table showing image results in terms of the surface roughness of a base and a resolution for an electrophotographic photoreceptor in an image forming apparatus without an undercoating layer;

DETAILED DESCRIPTION OF THE PREFERRED EMBODIMENTS

Embodiments of the present invention will be described with reference to the drawings and examples.

Figure 1:
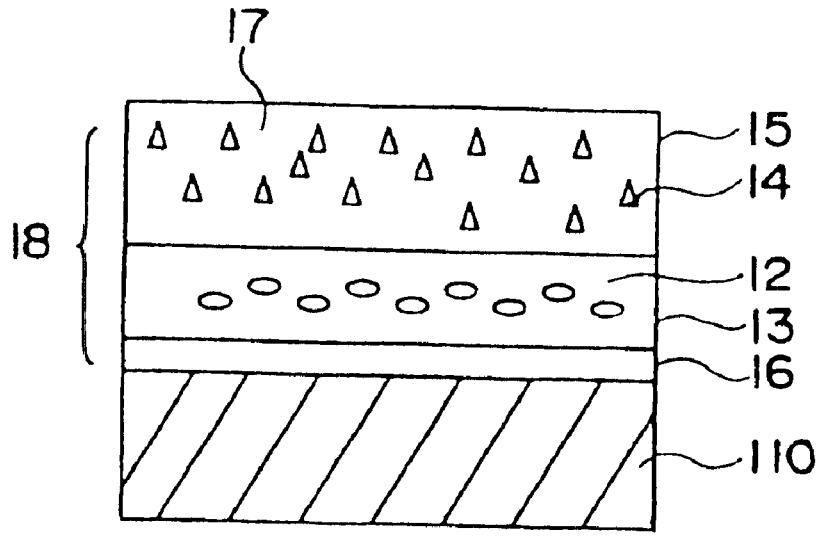
FIG. 1 illustrates a cross-section of a photoreceptor in an image forming apparatus according to the present invention.
Figure 2:
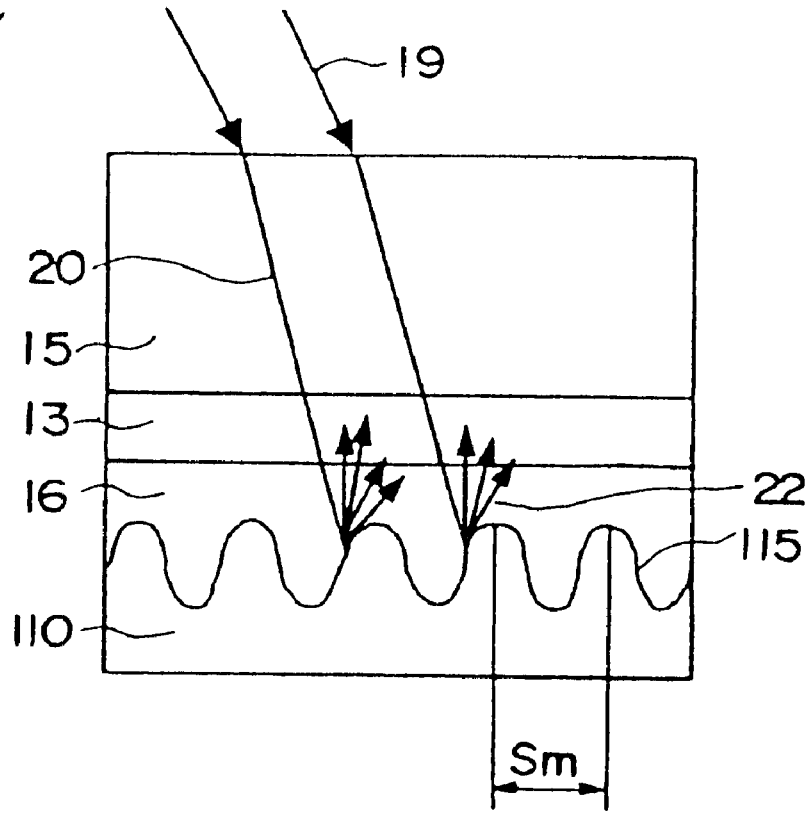
FIG. 2 is a functional illustration of a photoreceptor in an image forming apparatus according to the present invention.

FIG. 1 is a cross-section illustrating a laminated photoreceptor in a photoreceptor drum developed for a copier or printer employing a digital electrophotographic process aiming at improved image quality and a higher resolution according to this invention. FIG. 2 is a functional illustration of a laminated photoreceptor in an image forming apparatus according to this invention. The same symbols are used for the same parts as those in the configuration described in the section, "Description of the Prior Art", and therefore description is omitted.

A photoreceptor is a laminated photoreceptor comprising a photosensitive layer 18 comprising a laminate of an undercoating layer 16, a charge generation layer 13 based on a charge generating material 12 and a charge transport layer 15 comprising a compound as a charge transporting material 14 on a conductive support 110. In the laminated photoreceptor, the photosensitive layer 18 is negatively charged by, e.g., a corona charger. When being irradiated with a light with an absorption wavelength, the charge generation layer 13 generates charges of electrons and positive holes. The positive holes are moved to the surface of the photoreceptor by the charge transporting material contained in the charge transport layer 15 to neutralize the negative charge in the surface. On the other hand, the electrons in the charge generation layer 13 are moved towards the conductive support 110 in which a positive charge has been induced, to neutralize the positive charge, thus performing the function of a photoreceptor.

The laminated photoreceptor may be formed by applying a dispersion prepared by dispersing particles of the charge generating material 12 in a solvent or binder resin, on an undercoating layer 16 formed on a conductive support 110; applying a solution of a charge transporting material 14 and a binder resin 17 on the charge generation layer 13 thus formed; and drying the solution to form a charge transport layer 15.

The conductive support 110 functions as not only an electrode in a photoreceptor but also a support for other individual layers, and may have any form selected from a cylinder, a plate, a film and a belt. The conductive support may be made of a material selected from the group consisting of metals such as aluminum, stainless steel, copper and nickel; and insulative materials such as a polyester film, a phenol resin pipe and a paper pipe having a conductive layer such as aluminum, copper, palladium, tin oxide and indium oxide provided on its surface. It preferably exhibits electrical conductivity corresponding to a volume resistivity of $10^{10}$ Ωcm or less, and may be subject to surface oxidation for adjusting a volume resistance.

The undercoating layer 16 may be made of, for example, a material selected from polyamide, polyurethane, cellulose, nitrocellulose, polyvinyl alcohol, polyvinylpyrrolidone, polyacrylamide, aluminum anodized coating, gelatin, starch, casein and N-methoxymethylated nylon. Furthermore, particles of titanium oxide, tin oxide and/or aluminum oxide may be dispersed in the material. The undercoating layer 16 may have a film thickness of about 0.1 to about 10 μm so that it can function as an adhesion layer between the conductive support 110 and the photosensitive layer 18. In addition, it functions as a barrier layer for minimizing a charge in the conductive support 110 flowing into the photosensitive layer 18.

Thus, the undercoating layer 16 can maintain charging properties of the photoreceptor to increase a lifetime of the photoreceptor itself.

The charge generation layer 13 comprises a known charge generating material. A charge generating material 12 suitable for this invention may be any of inorganic pigments, organic pigments and organic dyes which generate a free charge by absorbing a laser beam. Examples of an inorganic pigment include selenium and its alloys, selenium arsenide, cadmium sulfide, zinc oxide, amorphous silicon and other inorganic photoconductors. Examples of an organic pigment include phthalocyanines, azo compounds, quinacridones, polycyclic quinones and perylenes; in particular, phthalocyanines are frequently used. Examples of an organic dye include thiapyrylium salts and squalirium salts. Among them, phthalocyanines are suitable; particularly, titanyl phthalocyanines are most suitably used. In addition to the above pigments and dyes, the charge generation layer 13 may comprise an electron acceptor material as a chemical sensitizer including cyano compounds such as tetracyanoethylene and 7,7,8,8-tetracyanoquinodimethane; quinones such as anthraquinone and p-benzoquinone; nitro compounds such as 2,4,7-trinitrofluorenone and 2,4,5,7-tetranitrofluorenone; or a dye as a photosensitizer including xanthene dyes, thiazine dyes and triphenylmethane dyes.

The charge generation layer 13 may be formed by dispersing a charge generating material and a binder resin in an appropriate solvent; applying the dispersion on a conductive support 110; and drying or curing the applied dispersion to form a film. A thickness of the charge generation layer 13 is about 0.05 to about 5 μm, preferably about 0.1 to about 1 μm. The charge generation layer 13 may be generally formed by vapor deposition such as evaporation, sputtering and CVD, or by applying a dispersion of a charge generating material pulverized and dispersed in a solvent using, e.g., a ball mill, a sand grinder, a paint shaker or an ultrasonic disperser, which may optionally contain a binder resin. Application may be conducted by a known method using, for example, a baker applicator, a bar coater, casting or spin coating when the conductive support 110 is a sheet, or spraying, a vertical ring process or dip coating when the conductive support 110 is a drum.

Examples of a binder resin 17 include polyallylates, polyvinylbutyral, polycarbonates, polyesters, polystyrene, polyvinyl chloride, phenoxy resins, epoxy resins, silicones and polyacrylates. Examples of a solvent used herein include isopropyl alcohol, cyclohexanone, cyclohexane, toluene, xylenes, acetone, methyl ethyl ketone, tetrahydrofuran, dioxane, dioxolane, ethylcellosolve, ethyl acetate, methyl acetate, dichloromethane, dichloroethane, monochlorobenzene and ethyleneglycol dimethyl ether. Basically, solvents other than those described above may be used, including alcohols, ketones, amides, esters, ethers, hydrocarbons, chlorinated hydrocarbons and aromatics alone or in combination. In particular, in view of desensitization due to crystal transition of the charge generating material during pulverization and milling as well as property deterioration due to a pot life, a preferable material may be selected from cyclohexanone, 1,2-dimethoxyethane, methyl ethyl ketone and tetrahydroquinone, which tend to inhibit crystal transition in both pigments.

The binder resin 17 used in the charge transport layer 15 may be substantially similar to those used for the charge generation layer 13, including polycarbonates, polyallylates, polyesters, polyether ketones, epoxy resins, urethanes, cellulose ethers and copolymers of monomers used for forming the above resins.

The charge transport material 14 may be made of an appropriate material selected from triphenyl amines, styryl compounds and hydrazones.

A solvent used for dissolving or dispersing the above charge transporting material 14 is substantially similar to those for dispersing the charge generating material 12 in forming the above charge generation layer 13 and can be selected from those exemplified for the charge generating material 12. A particularly preferable solvent is tetrahydrofuran.

To the charge transport layer 15, a plasticizer or leveling agent may be, if necessary, added. Examples of a leveling agent which may be used include silicone oils as well as polymers and oligomers having a perfluoroalkyl side chain. The amount of the leveling agent is suitably 0 to 1 part by weight per 100 parts by weight of a binder resin used in the charge transport layer 15.

Since a photoreceptor is used in an ozone atmosphere, a known antioxidant may be added for improving durability.

The charge transport layer 15 may be formed by a known technique using a baker applicator, a bar coater, casting or spin coating when the conductive support 110 is a sheet, or spraying, a vertical ring process or dip coating when the conductive support 110 is a drum. In particular, dip coating is generally preferable in terms of productivity and a cost. In the dip coating, the charge transport layer 15 may be formed by dissolving (or dispersing) the charge transporting material 14 and a binder resin 17 in a suitable solvent; applying the solution or dispersion on a conductive support 110 on which a charge generation layer 13 has been formed; and drying or curing the coated layer. A coating liquid for the charge transport layer 15 may be generally prepared with no problems by weighing one or several charge transporting materials 14, a binder resin 17 and an additive and dissolving them together in a predetermined amount of an organic solvent, but may be preferably prepared by first dissolving a binder resin in a solvent and then adding and dissolving the charge transporting material 14. The latter process may improve dispersion of the molecules of the charge transport material 14 into the binder resin 17 and inhibit potential and local crystallization of the charge transport material in the film, resulting in improvement in initial sensitivity, stabilization of a potential during repeated use and improved image properties. A film thickness of the charge transport layer 15 is about 10 to about 50 μm, preferably about 10 to about 35 μm.

In a photoreceptor thus formed, the conductive support 110 of this invention has a rough surface 115 formed for preventing interference fringe generation.

Generation of interference fringes in relation to a roughness was observed in an experiment.

In this experiment, an average distance Sm for an irregularity was fixed to about 30 μm to facilitate determination of effects of a surface roughness in the conductive support, base pipe (conductive support) samples described in the examples with different surface roughnesses were prepared and the state of an image in relation to a resolution was observed.

EXAMPLE 1

The following materials were applied on a base pipe to prepare a photoreceptor drum having a laminated structure.

The following materials were dispersed by a paint shaker for 10 hours to prepare a coating liquid for an undercoating layer.

Materials

Titanium dioxide ($Al_2O_3$, $ZrO_2$ surface treated dendritic rutile type titanium component 85%) TTO-MI-1 (Ishihara Sangyo Kaisha, Ltd.): 3 parts by weight CM-8000 (Toray Industries, Inc.), an alcohol-soluble nylon resin: 3 parts by weight Methanol: 60 parts by weight 1,3-Dioxolane: 40 parts by weight The coating liquid for the undercoating layer thus prepared was applied to 1.2 μm by dip coating on an aluminum cylindrical support with a diameter of 30 mm and a length of 326 mm to form an undercoating layer.

Then, a coating liquid for a charge generation layer was prepared by dispersing a mixture of 10 parts by weight of a butyral resin (S-LEC BL-2; Sekisui Chemical Co., Ltd.), 1400 parts by weight of dimethoxyethane and 15 parts by weight of titanyl phthalocyanine which is a compound represented by Formula 1 for 72 hours by a ball mill.

The coating liquid was applied by dip coating on the aluminum cylindrical base comprising the undercoating layer to a thickness of 0.2 μm to form a charge generation layer.

[Formula 1]

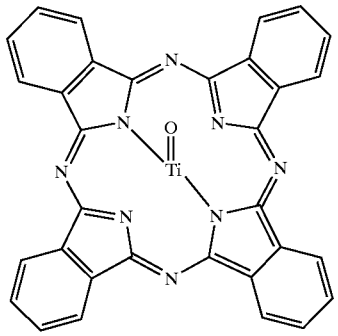

Then, a coating liquid for a charge transport layer was prepared by dissolving 100 parts by weight of a charge transporting material which is a compound represented by Formula 2, 160 parts by weight of a Z-type polycarbonate resin (Z 200; Mitsubishi Engineering Plastic Inc.) with a viscosity average molecular weight of 21000 which is compound represented by Formula 3 and 0.02 parts by weight of silicone oil in 1000 parts by weight of THF. The liquid was applied by dip coating on the above charge generation layer to a thickness of 20 μm, and dried at 120° C. for 1 hour to prepare a photoreceptor sample.

[Formula 2]

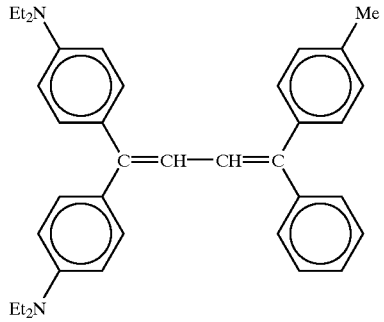

[Formula 3]

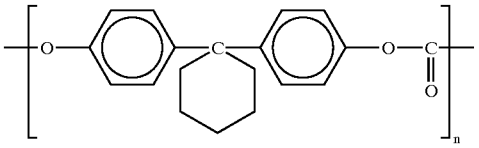

Samples were prepared, varying a roughness (R) in a base pipe in a photoreceptor drum by adjusting the maximum roughness within the limits of 0.58 μm≦Rmax≦2.584 μm. For a drum prepared by applying the above photosensitive layer on the sample, a resolution was varied by adjusting a peripheral speed using a copier which can adjust a peripheral speed (Sharp Corporation; modified AR-N200 digital copier) to check problems in an image for a half tone image. A light source for the modified machine was a semiconductor laser (wavelength: 785 nm) with a spot diameter of 65 μm.

Figure 6:
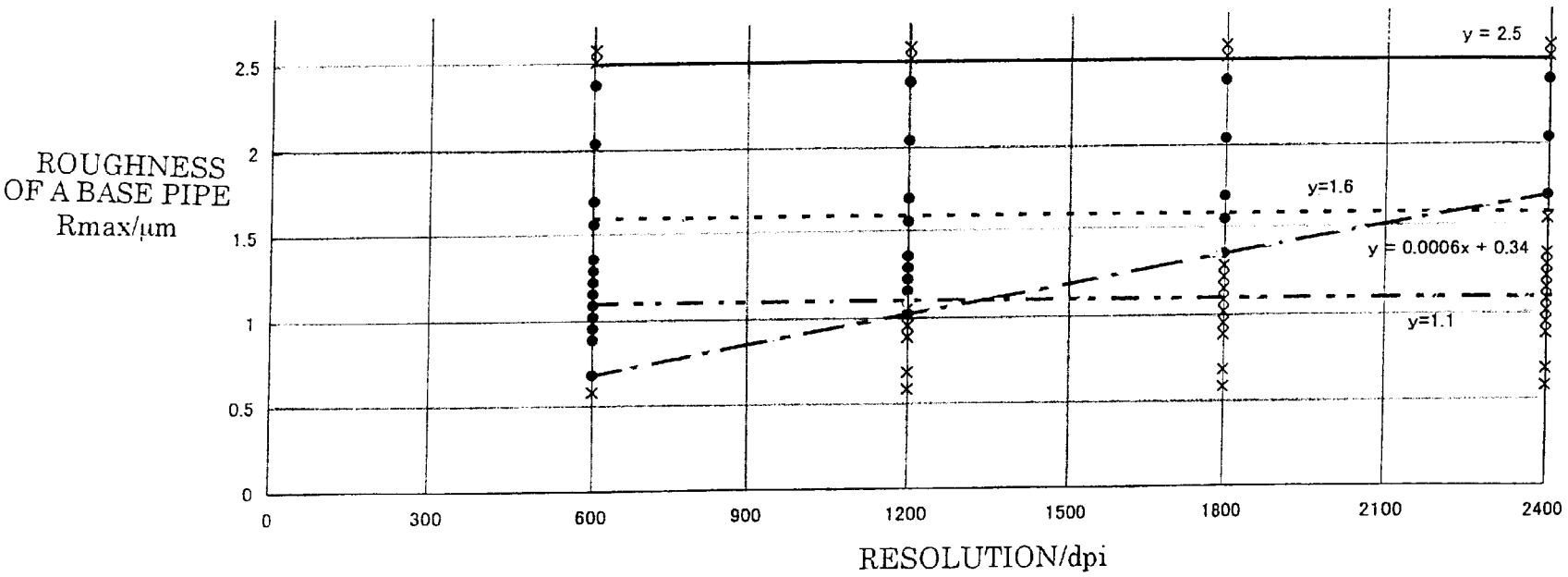
FIG. 6 is a graph showing the relation between the surface roughness of a base and a resolution with respect to interference fringes.
Figure 7:
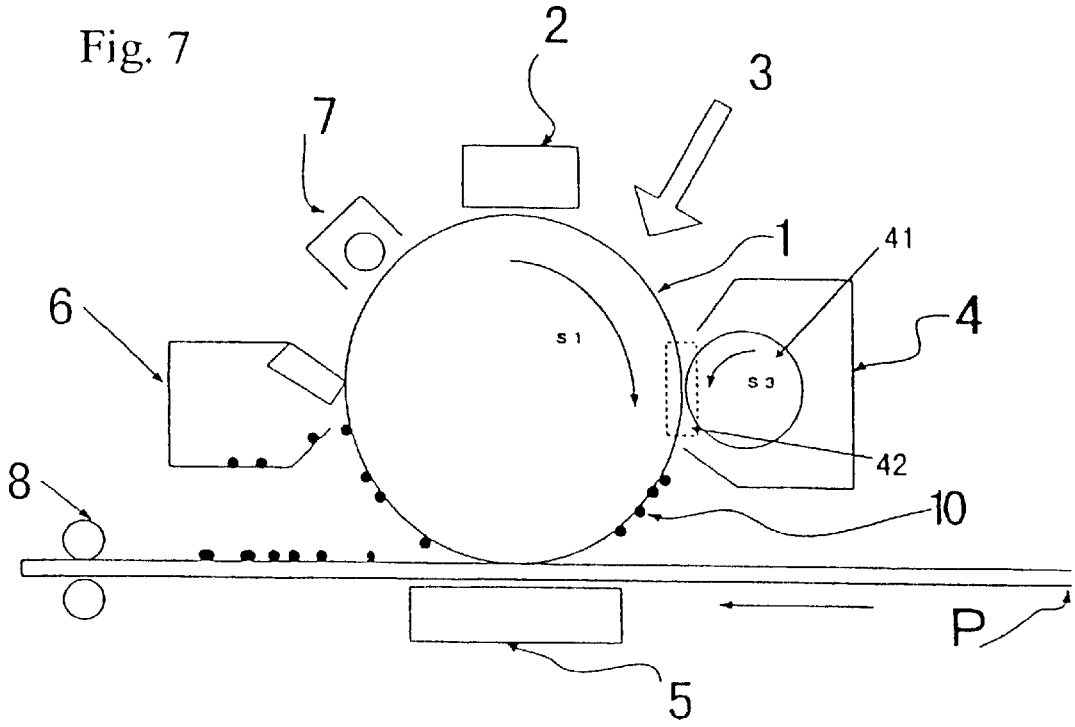
FIG. 7 illustrates an electrophotographic process.
Figure 8:
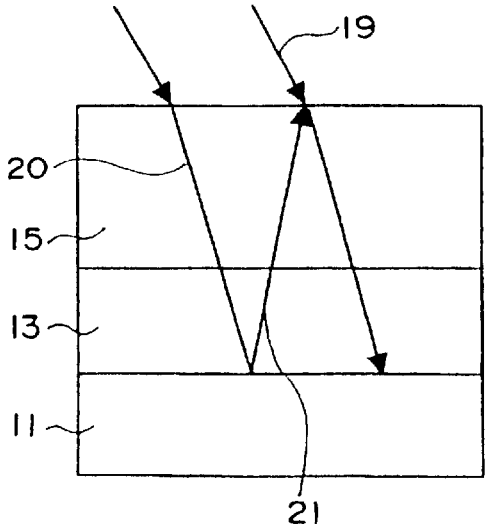
FIG. 8 is a functional illustration in a conventional electrophotographic photoreceptor.

Table 1 shown in FIG. 3 shows the investigation results, which is graphically shown in FIG. 6 where the upper and lower limits of a roughness are indicated with a solid line and a dashed line, respectively.

At a resolution of 1200 dpi, interference fringes were observed when the lower limit of a roughness is 1.02 or less, due to insufficient roughness in the support pipe surface. The lower limit increases as a resolution is increased. The results illustrated in the graph indicate that the lower limit of a roughness where no interference fringes are observed in an image can be expressed as the lower roughness limit $R \geqq 0.0006x+0.34$ where x is a resolution from the relation between the resolution and the surface roughness.

If the upper roughness limit was 2.5 or more, the surface of the base pipe was excessively rough so that a problem of appearance of the shape of the base pipe surface in an image was observed from the relation between the resolution and the surface roughness.

EXAMPLE 2

An undercoating layer without $TiO_2$ was applied on a base pipe with a roughness of 1 $\mu$m or 1.5 $\mu$m such that the undercoating layer had one of three dry thicknesses, 1.0, 0.5 and 0.2 $\mu$m. On the layer was applied a photosensitive layer to prepare a drum.

A mixture of CM-8000 (Toray Industries, Inc.), an alcohol-soluble nylon resin: 3 parts by weight, Methanol: 60 parts by weight and 1,3-Dioxolane: 40 parts by weight was stirred by a stirrer to prepare a coating liquid for an undercoating layer. The subsequent steps were conducted as described in Example 1.

Each drum thus prepared was used for checking a 1200 dpi image printed by the above modified machine.

As a result, for a sample in which the undercoating layer is thicker, an image density was reduced because a surface potential was not sufficiently reduced by an exposure. In this Example, a drum giving a desirable image concentration was obtained only where an undercoating layer had a thickness of 0.2 $\mu$m.

EXAMPLE 3

An experiment was conducted for a photoreceptor drum in which a photosensitive layer (a charge generation layer and a charge transport layer) was applied as described in Example 1, except that an undercoating layer without $TiO_2$ was formed to a dry thickness of 0.2 $\mu$m.

The results are shown in a table in FIG. 4 and also in FIG. 6 with a broken line.

As apparent from the results, when using an undercoating layer without $TiO_2$, a photosensitive layer was affected by a large rough area to generate black spots in a white area in an image, leading to a lower upper limit in comparison with the results in Example 1.

EXAMPLE 4

Using the base pipe described in Example 1, an experiment was conducted for a photoreceptor drum in which a photosensitive layer (a charge generation layer and a charge transport layer) was applied as described in Example 1, except that an undercoating layer was not formed.

The results are shown in the table in FIG. 5 and also in FIG. 6 with a two-dot chain line.

As apparent from the results, without an undercoating layer, the upper limit might be more reduced than the results in Example 1 or 3 because of the reason similar to that in Example 3.

As described in these examples, a conductive support with a surface roughness within a predetermined range can be used to prevent problems (mainly interference fringes) in an image in image forming for improved image quality.

This will be described with reference to FIG. 2. A laser beam 19 enters a photosensitive layer 15 as an incident light 20. The incident light 20 is diffused and reflected on a rough surface 115 of a support 110, and becomes a scattered light 22. The scattered light 22 is scattered by an inorganic oxide dispersedly contained in an undercoating layer 16 to reduce generation of interference fringes. The undercoating layer 16 may prevent white spots (or black spots) in an image forming area by reducing a large rough surface 115 in the support 110.

An undercoating layer may be formed between a support and a photosensitive layer to allow a charge generation layer (CGL) and a charge transport layer (CTL) to be evenly applied on top of the support with a rough surface. Furthermore, such even application may allow an area without interference fringes (the area indicated with a solid line and a dashed line in FIG. 6) to be larger than that without an undercoating layer (UCL). Forming an undercoating layer (UCL) may result in preventing deterioration in charging properties during repeated use, reducing a W-charge and improving charging properties under the conditions of a low temperature and a low humidity.

As described above, according to an image forming apparatus and a process for forming an image of the present invention, a conductive support with a surface roughness within given upper and lower limits may be used to prevent problems (mainly interference fringes) in an image in image forming for improved image quality.

Forming an undercoating layer on a conductive support allows upper layers, i.e., a charge generation layer (CGL) and a charge transport layer (CTL) to be evenly applied. Thus, interference fringes can be prevented in a range with a higher resolution. The undercoating layer can prevent deterioration in charging properties during repeated use, reduce a W-charge and improve charging properties under the conditions of a low temperature and a low humidity. Addition of an inorganic oxide to the undercoating layer may contribute to controlling of a resistance in the undercoating layer, scattering a transmitted light and reducing interference fringes. Furthermore, even when a base pipe surface is sufficiently rough to inhibit interference fringes, such a rough surface does not appear in an image.

What is claimed is:

1. An image forming apparatus comprising:

an electrophotographic photoreceptor including a photosensitive layer formed on a conductive support;

exposure means for exposing the photoreceptor to form an electrostatic latent image;

developing means for visualizing the latent image with a toner into a visualized image; and transfer means for transferring the visualized image to a transfer medium, wherein the conductive support in the photoreceptor has a surface roughness defined by the equation:

$$(0.0006x+0.34)\ \mu m <= Rmax <= 2.5\ \mu m$$

where roughness is represented by the maximum roughness Rmax and x is a resolution, and means for adjusting the lower limit of maximum roughness Rmax based on resolution so that the lower limit of Rmax increases as a function of increasing resolution and decreases as a function of decreasing resolution; and an undercoating layer is formed between the photosensitive layer and the conductive support.

2. The image forming apparatus according to claim 1 wherein the undercoating layer contains an inorganic oxide.

3. A process for forming an image comprising:

forming an electrostatic latent image by exposing an electrophotographic photoreceptor having a photosensitive layer formed on a conductive support to a laser beam carrying an even charge and image information;

visualizing the latent image with a toner into a visualized image;

transferring the visualized image to a transfer medium, wherein a rough surface having a roughness (Rmax) within the range defined by the equation:

$$1.02\ \mu m <= Rmax <= 2.5\ \mu m$$

is formed in the surface of the conductive support in the electrophotographic photoreceptor and forming an undercoating layer on the base for making the photosensitive layer even and preventing interference fringes during exposure with a semiconductor laser at a resolution of 1200 dpi or more; and adjusting the lower limit of maximum roughness Rmax based on resolution so that the lower limit of Rmax increases as a function of increasing resolution and decreases as a function of decreasing resolution for at least some resolutions.

4. The process for forming an image according to claim 3 wherein an undercoating layer containing an inorganic oxide is formed on a conductive support to scatter a laser beam for preventing interference fringes.

* * * * *